US006925946B1

(12) United States Patent
Kang

(10) Patent No.: US 6,925,946 B1
(45) Date of Patent: Aug. 9, 2005

(54) EMBROIDERY MACHINE

(75) Inventor: Doo-Hwa Kang, Inchon (KR)

(73) Assignee: Sunstar Precision Co., Ltd., (KR)

( * ) Notice: Subject to any disclaimer, the term of this patent is extended or adjusted under 35 U.S.C. 154(b) by 0 days.

(21) Appl. No.: 10/797,279

(22) Filed: Mar. 10, 2004

(30) Foreign Application Priority Data

Feb. 5, 2004 (KR) ..... 20-2004-0002835 U

(51) Int. Cl.[7] ..... D05B 21/00
(52) U.S. Cl. ..... 112/102.5; 112/103
(58) Field of Search ..... 112/78, 102.5, 112/103, 475.18, 475.19, 155, 470.06

(56) References Cited

U.S. PATENT DOCUMENTS 5,474,001 A * 12/1995 Tajima et al. ..... 112/102.5
5,937,774 A * 8/1999 Hayashi ..... 112/103
6,698,369 B2 * 3/2004 Kwak ..... 112/102.5

* cited by examiner

*Primary Examiner*—John Calvert
*Assistant Examiner*—Brian Kauffman
(74) *Attorney, Agent, or Firm*—Galgano & Burke, LLP

(57) ABSTRACT

An embroidery machine can simultaneously embroider sewing objects having various shapes, including a flat object, an object having a shape of a usual processed cloth, an object having a shape of a cap, etc. The embroidery machine comprises a plurality of sewing heads grouped into at least two working groups, and the embroidering frames, each of which is arranged for one of the working groups. The embroidering frames have structures either identical to each other or different from each other. Therefore, one conventional embroidery machine can simultaneously embroider more than one kind of sewing objects, including at least two of a flat sewing object, a tubular sewing object, and a cap-shaped sewing object.

34 Claims, 4 Drawing Sheets

EMBROIDERY MACHINE

BACKGROUND OF THE INVENTION

1. Field of the Invention

The present invention relates to an embroidery machine, and more particularly to a multi-functional embroidery machine, which can simultaneously embroider sewing objects having various shapes, including a flat object, an object having a shape of a usual processed cloth, an object having a shape of a cap, etc., without replacement or addition of the machine or any separate part for the machine.

2. Description of the Prior Art

As generally known in the art, embroidery machines can be classified into flat type embroidery machines and tubular type embroidery machines. In the flat type embroidery machine, a flat object is secured on a rectangular frame and is then embroidered by the cooperation between a sewing head and a reel unit. In the tubular type embroidery machine, an object having a shape of a usual processed cloth, such as T-shirt, or a sewing object shaped like a cap is secured and embroidered by a processed cloth supporting frame or a cap frame. The flat type embroidery machine has a bed structure suitable for embroidering of a flat sewing object, and the tubular type embroidery machine has a structure suitable for embroidering of a tubular object and a sewing object for a cap. However, it is impossible for only one conventional embroidery machine to simultaneously embroider more than one kind of sewing objects (e.g., including at least two of a flat sewing object, a tubular sewing object, and a cap-shaped sewing object).

That is, in a conventional embroidery machine, a plurality of sewing heads and a plurality of reel units provided corresponding to the sewing heads are synchronized and operated by one driving source. The conventional embroidery machine has one driver which drives an embroidering frame. Thus, one embroidery machine cannot simultaneously embroider multiple kinds of sewing objects including flat objects, tubular objects, and sewing objects for caps.

In order to solve such problems, it has proposed an embroidery machine, which can embroider multiple kinds of sewing objects.

The embroidery machine is a flat type embroidery machine including a plurality of independent driving embroidering frames which are separately installed. In the embroidery machine, a plurality of sewing heads are divided into at least two head groups separately mounted on an upper beam. Each of the head groups includes an embroidering frame for securing a sewing object and an embroidering frame driver for driving the embroidering frame in X and Y directions.

In operation of the flat type embroidery machine, a flat object is secured to each embroidering frame corresponding to each head group, and then corresponding embroidering frame drivers are individually driven. Accordingly, sewing objects having different patterns can be simultaneously embroidered by one embroidering machine to maximize operation efficiency and mass production.

However, the independent-type driving embroidery machine as described above includes a shuttle bed having a short length suitable to embroider flat objects and has a difficulty in embroidering a tubular object such as a cap or a T-shirt.

The shuttle bed and the embroidering frame driver (X and Y axis drivers) have structures in which a driving unit of a cap frame and a tubular round frame support member can not be mounted to the embroidering fame driver.

An embroidery machine has been required to solve such problems occurring as in the disclosed machine and to have a construction capable of simultaneously embroidering multiple kinds of sewing objects, including flat objects, tubular objects, and cap-shaped objects.

SUMMARY OF THE INVENTION

Accordingly, the present invention has been made to solve the above-mentioned problems occurring in the prior art and an object of the present invention is to provide an embroidery machine, which can simultaneously embroider sewing objects having various shapes, including a flat object, an object having a shape of a usual processed cloth, an object having a shape of a cap, etc.

Another object of the present invention is to provide an embroidery machine, which allows a worker to conveniently embroider a sewing object.

A further object of the present invention is to provide an embroidery machine, which has a structure suitable for production of various kinds and small amounts of goods, can facilitate the production of goods, and thereby can reduce the manufacturing cost.

In order to accomplish this object, there is provided an embroidery machine comprising: a plurality of sewing heads installed at an upper portion of a working table while being spaced a predetermined distance apart from each other, a plurality of shuttle beds being located at positions vertically corresponding to the sewing heads, the shuttle beds being arranged in a line; a plurality of embroidering frames installed between the sewing heads and the shuttle beds while being movable in X- and Y-axis directions; a plurality of X-axis drivers for moving each of the embroidering frames in the X-axis direction; a plurality of Y-axis driver for moving each of the embroidering frames in the Y-axis direction; a controller for controlling driving of the X and Y axis drivers; and an operating panel for displaying all information required for an embroidery pattern and an operation of embroidering and enabling input of the information, and wherein the sewing heads are grouped into at least two working groups, each of the embroidering frames is arranged for one of the working groups, and the embroidering frames have structures either identical to each other or at least two different structures.

Each of the embroidering frames includes at least one of a border frame unit, a tubular frame unit, and a cap frame drive unit. A plurality of units corresponding to the plurality of heads are installed at each of the work groups are integrally formed on each other when the embroidery frame is the tubular fine unit or the cap frame drive unit. Each of X and Y axis drivers includes a moving member and a driving source for moving the moving member, and the moving member of the X axis drivers includes a frame holder for securing the embroidering frame therein and mounted on the moving member of the respective Y axis driver. The frame holder reciprocates in an X direction by driving the X-axis driver.

Each of X and Y axis drivers includes a moving member and a driving source for moving the moving member, and the driving source is a rotary motor. The controller allows a worker to operate or stop one of the X and Y-axis drivers. The controller allows the plurality of embroidering frames to selectively embroider one pattern or different patterns, respectively.

One operating panel is provided in the plurality of working groups. The operating panel is located at a boundary between two working groups when the two working groups are used. The operating panel simultaneously or sequentially embroidering pattern and progress information for all working groups being in progress. One controller controls driving of the X and Y axis drivers.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
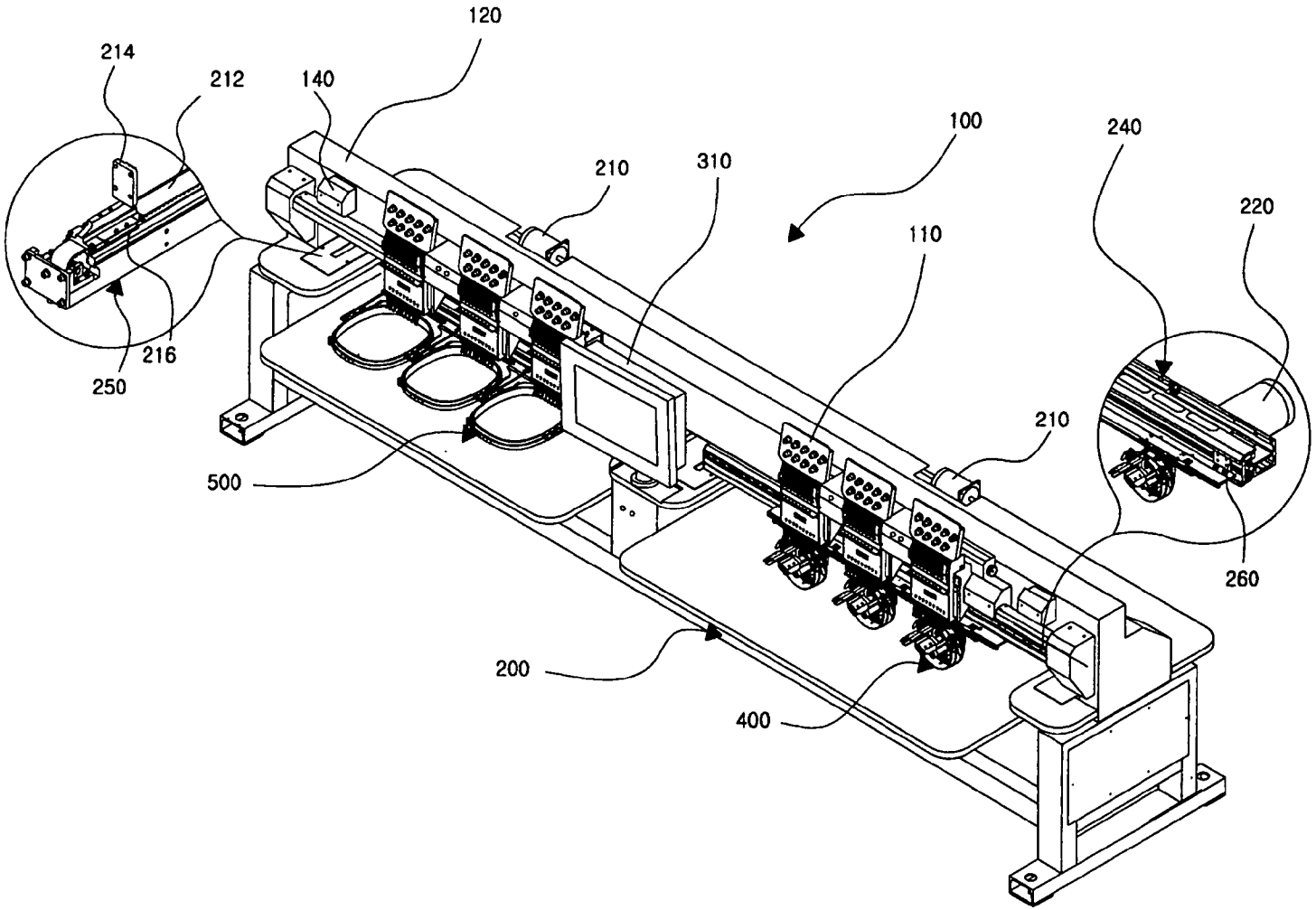
FIG. 1 is a perspective view for showing an embroidery machine according to an embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

An embodiment of the present invention will be now explained referring to the FIGS. 1 through 4.

Figure 2:
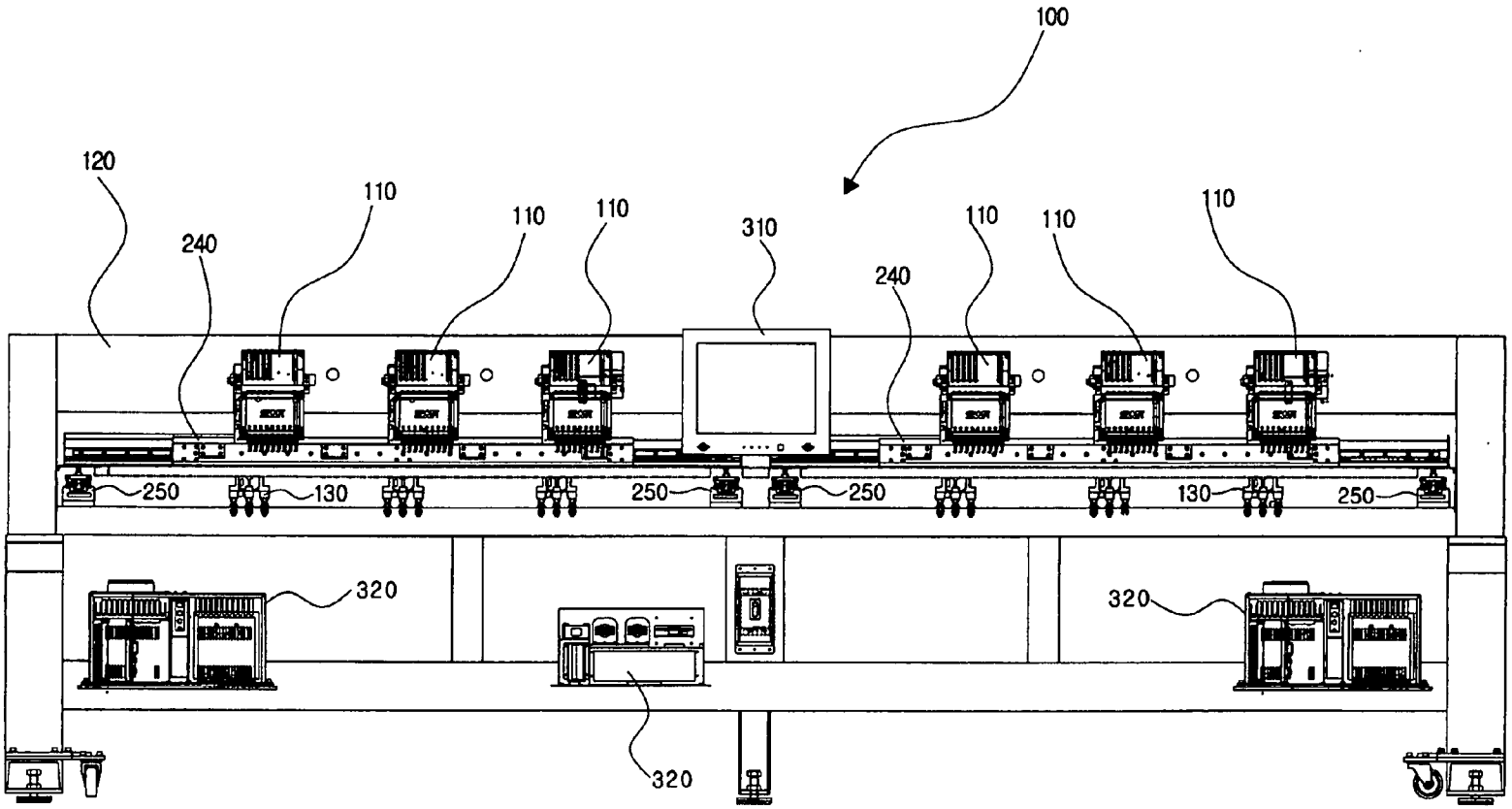
FIG. 2 is a front view of the embroidery machine shown in FIG. 1.
Figure 3:
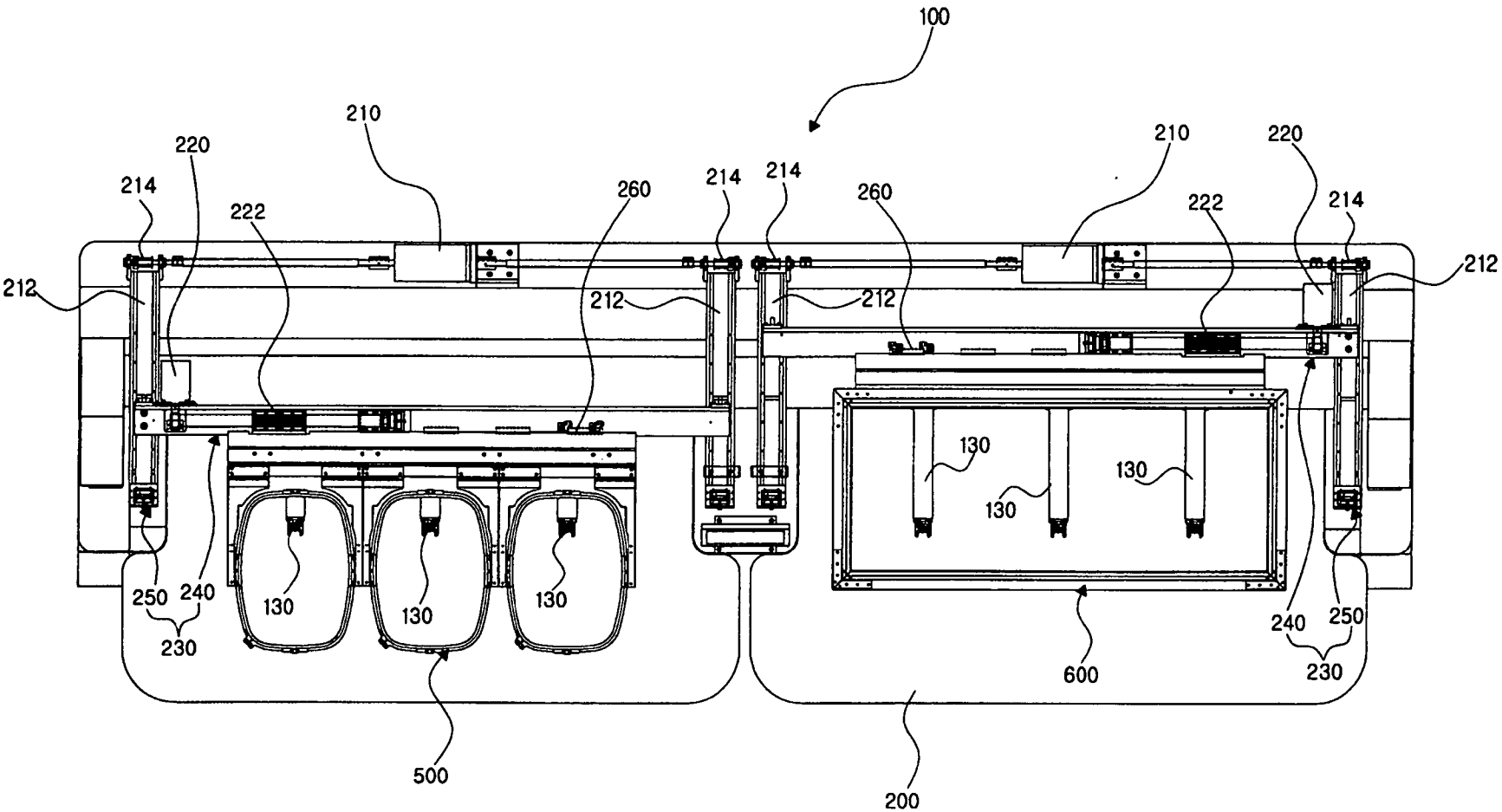
FIG. 3 is a plan view of the embroidery machine shown in FIG. 1.
Figure 4:
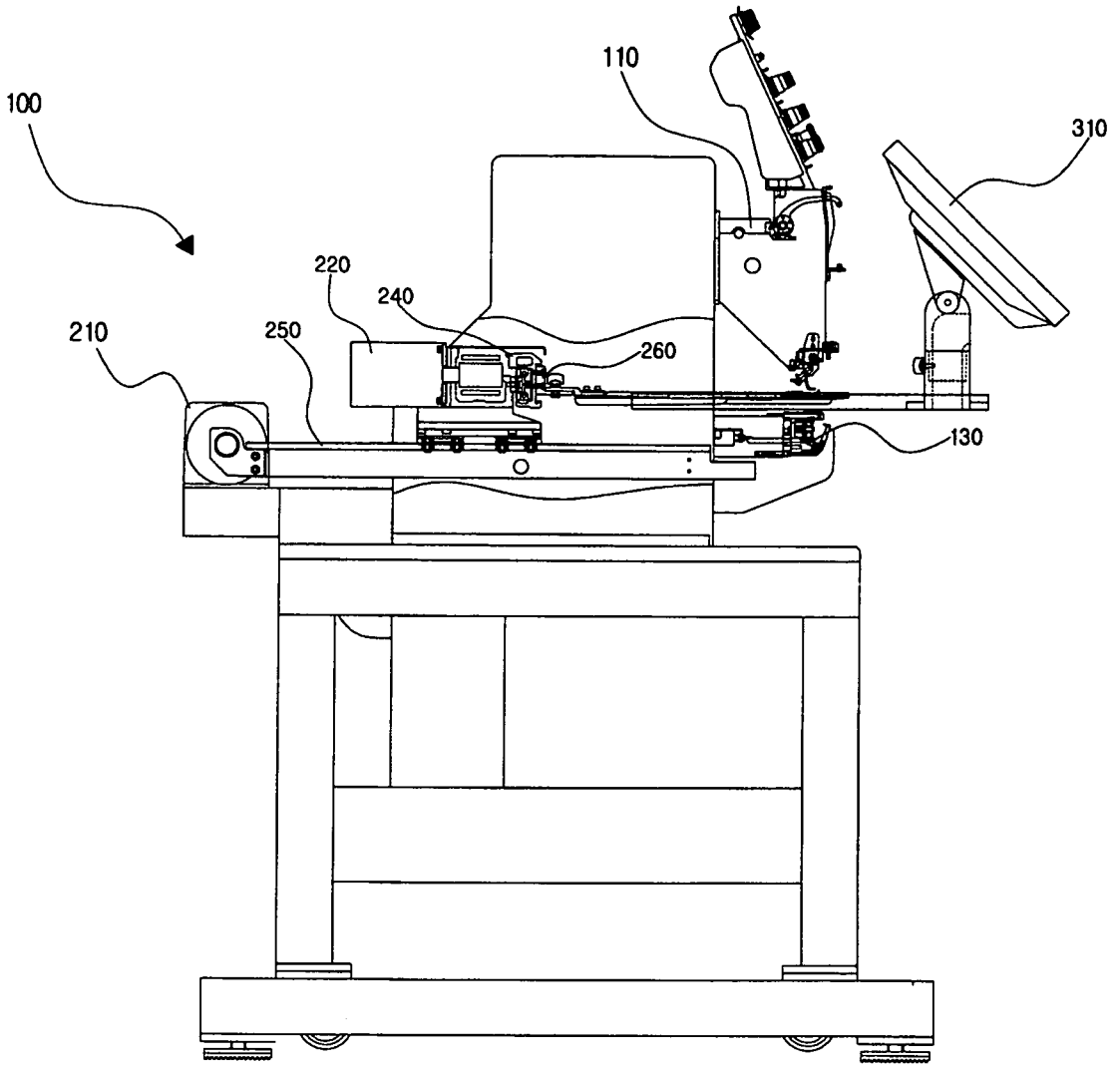
FIG. 4 is a side view of the embroidery machine shown in FIG. 1.

FIG. 1 is a perspective view for showing an embroidery machine according to an embodiment of the present invention. FIG. 2 is a front view of the embroidery machine shown in FIG. 1. FIG. 3 is a plan view of the embroidery machine shown in FIG. 1. FIG. 4 is a side view of the embroidery machine shown in FIG. 1.

As shown in FIGS. 1 through 4, at least two working groups, each of which includes a plurality of sewing heads 110, are installed on a front side of an upper beam 120 while being spaced a predetermined distance apart from each other. The sewing heads 110 in each of the working groups are spaced a predetermined distance apart from each other. A plurality of shuttle beds 130, which cooperate with the sewing heads 110 to perform embroidering on multiple sewing objects, are installed at positions corresponding to the sewing heads 110. Here, it is preferred that each of the shuttle beds 130 has a cylindrical shape.

Further, it is noted from the drawings that the embroidery machine includes a working table 200, a plurality of embroidering frames, embroidering frame drivers 230, controllers 320, and an operating panel 310. Each of the embroidering frames is disposed on the working table 200 to hold a sewing object so that the embroidering frames enable the embroidery machine to simultaneously embroider multiple kinds of sewing objects. Each of the embroidering frame drivers 230 moves each of the embroidering frames in X-direction or Y-direction. Each of the controllers 320 controls the embroidering frame drivers 230 to individually operate, so as to allow the embroidering frames to either embroider the same patterns or multiple patterns different from each other. The operating panel 310 displays all information required for progressing of the embroidering and allows input of such information. Here, the operating panel 310 may include a display device and a key input section, preferably a touch screen.

Also, a plurality of operating panels 310 may be separately installed for all working groups. However, in order to simplify the structure of the embroidery machine and reduce manufacturing cost, it is preferred that only one operating panel is installed for all the working groups. The operating panel 310 is arranged at a predetermined position on the working table 200, which allows a worker to control all working groups by using the operating panel 310. For example, as shown in FIG. 1, the operating panel 310 is located at a boundary between two working groups, namely, at a center of the working table 200 when the two working groups are used.

Further, the worker inputs information required for embroidering operations of all working groups through the operating panel 310. While all working groups are in progress, the worker simultaneously or sequentially displays embroidering patterns and progress information with respect thereto through the operating panel 310. A display screen is divided into a plurality of screens corresponding to the number of the working groups and all information which the worker wants is simultaneously displayed on the divided screens. So, the worker simultaneously confirms embroidering situations of a plurality of working groups being in progress on one screen. If necessary, the progress information of the working groups is controlled to be displayed sequentially.

With reference to FIG. 3, each of the X and Y-axis drivers 230 includes an X-axis moving member 240, a Y-axis moving member 250, an X-axis driving motor 220, and a Y axis driving motor 210.

A frame holder 260 is mounted in the X-axis moving member 240, and secures the embroidering frame on the X-axis moving member 240. Two Y-axis moving members 250 are vertically arranged at both ends of the X-axis moving member 240. Since the X-axis moving 240 is mounted on the two Y axis moving members 250, the X axis moving 240 and the two Y axis moving members 250 reciprocate the embroidering frame in X direction (left and right) and Y direction (front and back) by driving the X and Y axis driving motors 220 and 210.

The X-axis moving member 240 includes a Y-axis driving motor 210 and X-drive timing pulleys 214. The Y-axis driving motor 210 is installed at a rear center of the working table 200 by sewing head groups. The X-drive timing pulleys 214 are installed at left and right ends of a driving shaft of the Y-axis driving motor 210. Each of the timing pulleys 214 is connected to each of Y-drive timing belts 212.

Left and right ends of the X-axis moving member 240 are supported and fixed on the Y-drive timing belt 212 using connecting bracket 216 and a timing belt fixing plate (not shown). An X-axis driving motor 220 is mounted at an upper end of the X-axis moving member 240.

The Y-drive timing belt 212 is connected to a driving source of the Y-axis driving motor 210. The X-axis moving member 240 is directly connected to the Y-axis driving motor 210 on the Y-drive timing belt 212. The X-axis moving member 240 reciprocates into a Y-axis direction (front and back directions) by driving the Y-axis driving motor 210.

The X-axis driving motor 220 is mounted at an upper end of the X-axis moving member 240. An X-drive timing belt 222 is connected to the driving source of the X-axis driving motor 220. A frame holder 260 is mounted at the X-drive timing belt 222 using a belt bracket (not shown) and an UM block connecting plate (not shown).

At this time, the frame holder 260 is connected to a border frame using a known locking member when the worker sews flat objects. The frame holder 260 is connected to a tubular frame unit by the known locking member when the worker sews tubular objects. The frame holder 260 is connected to a cap frame driving unit by the known locking member when the worker sews cap shaped sewing objects.

The frame holder 260 reciprocates in an X direction (left and right directions) by driving the X-axis driving motor 220.

As described above, the X and Y axis drivers 230 moves the X axis moving member 240 into the Y direction by driving the Y axis driving motor 210. Simultaneously, the X and Y axis drivers 230 moves the frame holder 260 into the X direction by driving the X axis driving motor 220 mounted on the X axis moving member 240.

Each of the X and Y driving motors 220 and 210 includes a rotary motor such as an AC servo-motor and a stepping motor. When the rotary motor is used for the X driving 220 or the Y driving motor 210, manufacturing cost, machine weight, and machine size are significantly reduced.

The controller 320 controls the driving of the X and Y driving motors 220 and 210. The controller 320 controls the X and Y driving motors 220 and 210 which allows one of the X and Y axis drivers 230 to be operated or stopped according to the worker's instruction.

Regardless of the number of working groups each having a plurality of head groups, one controller 320 is preferably installed at one embroidery machine. X and Y locations of the X and Y drivers 230 are determined according to the direction and distance of the movement by the X and Y driving motors 220 and 210 under the control of the controller 320.

Also, each of the sewing heads 110 installed at each of the working groups can selectively use a plurality of needle bars under a color converting control of each color changer 140, so as to use sewing threads of various colors.

An upper surface of each sewing head 100 and an upper surface of the working table 200 are formed at the same surface. Needle plates are provided at upper front surfaces of the sewing head 100 and working table 200.

In the embroidery machine 100 according to the present invention, a tubular frame unit 500 is mounted at X and Y-axis drivers 230, which are installed at one side of the working, table 200. The tubular frame unit 500 functions as a support member of a tubular round frame. A cap frame driving unit 400 is mounted at X and Y-axis drivers 230, which is installed at the other side of the working, table 200. Thus, the embroidery machine 100 simultaneously embroiders tubular objects as T-shirts and cap shaped sewing objects using the tubular frame unit 500 and cap frame driving unit 400.

In another embodiment of the present invention, at least one of embroidering frames having different structures from each other are selectively mounted at the X and Y-axis drivers 230. The embroidering frames include a tubular frame unit 500 which is a support member of a tubular round frame, a cap frame driving unit 400, and a border frame (not shown) for securing flat sewing objects. If necessary, embroidering frames having identical structures are mounted at the X and Y-axis drivers 230 every working group, so that the same embroidering operations are simultaneously performed at all the working groups.

When the embroidery frame mounted at the X and Y axis drivers 230 is a cap frame driving unit 400 or a tubular frame unit 500, the above embodiment of the present invention has been described for each unit installed to correspond to each sewing head 110 for one separately working group. According to another embodiment of the present invention, a plurality of units corresponding to a plurality of sewing heads for a working group are integrally formed on each other, and are attached and detached to and from the X and Y axis drivers 230 by the lump, respectively. In the case, it is very easy to attach and detach the units to and from the X and Y-axis drivers 230, respectively, causing saving an operating time.

After performing the above-mentioned process, the worker selects embroidering pattern data to be embroidered on sewing objects, which are secured to the X and Y-axis drivers 230.

According to the selected embroidering pattern data, the controller 320 moves the X and Y-axis drivers 230 which allows them to embroider each sewing objects. Since one embroidery machine simultaneously embroiders various kinds of sewing objects, the present invention is particularly advantageous in producing various kinds and small amounts of goods.

According to the present invention as described above, various kinds of sewing objects can be simultaneously embroidered by one embroidery machine. In addition, either identical sewing objects or different sewing objects, according to a worker's selection, can be simultaneously embroidered by one embroidery machine, so that productivity and operating efficiency can be maximized. Therefore, an embroidery machine according to the present invention is suitable for production of various kinds and small amounts of goods.

Further, an embroidery machine according to the present invention employs a rotary motor as the driving sources for X and Y-axis drivers, so that its manufacturing cost, machine weight, and machine size can be significantly reduced.

Furthermore, an embroidery machine according to the present invention may include only one operating panel installed at a predetermined location, for all working groups, which simplifies the structure of the embroidery machine and reduces manufacturing cost.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An embroidery machine comprising:

a plurality of sewing heads installed at an upper portion of a working table while being spaced a predetermined distance apart from each other;

a plurality of shuttle beds being located at positions vertically corresponding to the sewing heads, the shuttle beds being arranged in a line;

a plurality of embroidering frames installed between the sewing heads and the shuttle beds while being movable in X- and Y-axis directions;

a plurality of X-axis, drivers for moving each of the embroidering frames in the X-axis direction;

a plurality of Y-axis drivers for moving each of the embroidering frames in the Y-axis direction;

controller for controlling driving of the X and Y axis drivers;

operating panel for displaying all information required for an embroidery pattern and an operation of embroidering and enabling input of the information; and embroidering frames having at least two different structures, which each of the embroidering frames is arranged for one of at least two working groups which the sewing heads are grouped into; and wherein each of the embroidering frames includes at least one of a border frame unit, a tubular frame unit, and a cap frame drive unit, and a plurality of units corresponding to the plurality of heads are installed at each of the work groups are integrally formed on each other when the embroidery frame is the tubular frame unit or the cap frame drive unit.

2. An embroidery machine as claimed in claim 1, wherein each of X and Y axis drivers includes a moving member and a driving source for moving the moving member, and the driving source is a rotary motor.

3. An embroidery machine as claimed in claim 1, wherein the controller allows a worker to operate or stop one of the X and Y-axis drivers.

4. An embroidery machine as claimed in claim 1, wherein controller allows the plurality of embroidering frames to selectively embroider one pattern or different patterns, respectively.

5. An embroidery machine as claimed in claim 1, wherein operating panel provided in the plurality of working groups is one.

6. An embroidery machine as claimed in claim 1, wherein the operating panel is located at a boundary between two working groups when the two working groups are used.

7. An embroidery machine as claimed in claim 1, wherein the operating panel simultaneously or sequentially embroidering pattern and progress information for all working groups being in progress.

8. An embroidery machine as claimed in claim 1, wherein controller which controls driving of the X and Y axis drivers is one.

9. An embroidery machine comprising:

a plurality of sewing heads installed at an upper portion of a working table while being spaced a predetermined distance apart from each other;

a plurality of shuttle beds being located at positions vertically corresponding to the sewing: heads, the shuttle beds being arranged in a line;

a plurality of embroidering frames installed between the sewing heads and the shuttle beds while being movable in X- and Y-axis directions;

a plurality of X-axis drivers for moving each of the embroidering frames in the X-axis direction; a plurality of Y-axis drivers for moving each of the embroidering frames in the Y-axis direction;

controller for controlling driving of the X and Y axis drivers; and operating panel for displaying all information required for an embroidery pattern and an operation of embroidering and enabling input of the information;

embroidering frames having at least two different structures, which each of the embroidering frames is arranged for one of at least two working groups which the sewing heads are grouped into; and wherein the operating panel be located at a boundary between two working groups when the two working groups are used.

10. An embroidery machine as claimed in claim 9, wherein each of the embroidering frames includes at least one of a border frame unit, a tubular frame unit, and a cap frame drive unit.

11. An embroidery machine as claimed in claim 10, wherein a plurality of units corresponding to the plurality of heads are installed at each of the work groups are integrally formed on each other when the embroidery frame is the tubular frame unit or the cap frame drive unit.

12. An embroidery machine as claimed in claim 9, wherein each of X and V axis drivers includes a moving member and a driving source for moving the moving member, and the driving source is a rotary motor.

13. An embroidery machine as claimed in claim 9, wherein the controller allows a worker tp operate or stop one of the X and Y-axis drivers.

14. An embroidery machine as claimed in claim 9, wherein the controller allows the plurality of embroidering frames to selectively embroider one pattern or different patterns, respectively.

15. An embroidery machine as claimed in claim 9, wherein operating panel provided in the plurality of working groups is one.

16. An embroidery machine as claimed in claim 9, wherein the operating panel simultaneously or sequentially embroidering pattern and progress information for all working groups being in progress.

17. An embroidery machine as claimed in claim 9, wherein the controller which controls driving of the X and Y-axis drivers is one.

18. An embroidery machine comprising:

a plurality of sewing heads installed at an upper portion of a working table while being spaced a predetermined distance apart from each other;

a plurality of shuttle beds being located at positions vertically corresponding to the sewing heads, the shuttle beds being arranged in a line;

a plurality of embroidering frames installed between the sewing heads and the shuttle beds while being movable in X- and Y-axis directions;

a plurality of X-axis drivers for moving each of the embroidering frames in the X-axis direction;

a plurality of Y-axis drivers for moving each of the embroidering frames in the Y-axis direction;

controller or controlling driving of the X and Y axis drivers;

operating panel for displaying all information required for an embroidery pattern and an operation of embroidering and enabling input of the information; and embroidering frames having structures identical to each other, which each of the embroidering frames is arranged for one of at least two working groups which the sewing heads are grouped into; and wherein each of the embroidering frames includes anyone of a border frame unit, a tubular frame unit, or a cap frame drive unit, and a plurality of units corresponding to the plurality of heads are installed at each of the work groups are integrally formed on each other when the embroidery frame is the tubular frame unit or the cap frame drive unit.

19. An embroidery machine as claimed in claim 18, wherein each of X and Y axis drivers includes a moving member and a driving source for moving the moving member, and the driving source is a rotary motor.

20. An embroidery machine as claimed in claim 18, wherein the controller allows a worker, to operate or stop one of the X and Y-axis drivers.

21. An embroidery machine as claimed in claim 18, wherein the controller allows the plurality of embroidering frames to selectively embroider one pattern or different patterns, respectively.

22. An embroidery machine as claimed in claim 18, wherein operating panel provided in the plurality of working groups is one.

23. Embroidery machines claimed in claim 18, wherein the operating, panel is located at a boundary between two working groups when the two working groups are used.

24. An embroidery machine as claimed in claim 18, wherein the operating panel simultaneously or sequentially embroidering pattern and progress information for all working groups being in progress.

25. An embroidery machine as claimed in claim 18, wherein controller which controls driving of the X and Y axis drivers is one.

26. An embroidery machine comprising:

a plurality of sewing, heads installed at an upper portion of a working table while being spaced a predetermined distance apart from each other;

a plurality of shuttle beds being located at positions vertically corresponding to the sewing heads, the shuttle beds being arranged in a line;

a plurality of embroidering frames installed between the sewing heads and the shuttle beds while being movable in X- and Y-axis directions;

a plurality of X-axis drivers for moving each of the embroidering frames in the X-axis direction;

a plurality of Y-axis drivers for moving each of the embroidering frames in the Y-axis direction;

controller for controlling driving of the X and Y axis drivers; and operating panel for displaying all information required for an embroidery pattern and an operation of embroidering and enabling input of the information;

embroidering frames having structures identical to each other, which each of the embroidering frames is arranged for one of at least two working groups which the sewing heads are grouped into; and wherein the operating panel be located at a boundary between two working groups when the two working groups are used.

27. An embroidery machine as claimed in claim 26, wherein each of the embroidering frames includes anyone of a border frame unit, a tubular frame unit, or a cap frame drive unit.

28. An embroidery machine as claimed in claim 27, wherein a plurality of units corresponding to the plurality of heads are installed at each of the work groups are integrally formed on each other when the embroidery frame Is the tubular frame unit or the cap frame drive unit.

29. An embroidery machine as claimed in claim 26, wherein each of X and V axis drivers includes, a moving member and a driving source for moving the moving member, and the driving source is a rotary motor.

30. An embroidery machine as claimed in claim 26, wherein the controller allows a worker to operate or stop one of the X and V-axis drivers.

31. An embroidery machine as claimed in claim 26, wherein the controller allows the plurality of embroidering frames to selectively embroider one pattern or different patterns, respectively.

32. An embroidery machine as claimed in claim 26, wherein operating panel provided in the plurality of working groups is one.

33. An embroidery machine as claimed in claim 26, wherein the operating panel simultaneously or sequentially embroidering pattern and progress information for all working groups being in progress.

34. An embroidery machine as claimed in claim 26, wherein controller which controls driving of the X and Y-axis drivers is one.

* * * * *